US005342114A

United States Patent [19]

Burke et al.

[11] Patent Number: 5,342,114

[45] Date of Patent: Aug. 30, 1994

[54] CONVERTIBLE ROLLING CHAIR AND CHANGING TABLE FOR ADULT

[76] Inventors: Olive L. Burke, R.R. 1, Box 459A, Sapulpa, Okla. 74066; Jesse G. Lewis, 204 N. Vancouver Ave., Tulsa, Okla. 74127

[21] Appl. No.: 17,739

[22] Filed: Feb. 16, 1993

Related U.S. Application Data

[63] Continuation-in-part of Ser. No. 829,435, Feb. 3, 1992, abandoned.

[51] Int. Cl.[5] ..... A61G 7/015

[52] U.S. Cl. ..... 297/344.2; 297/354.13; 297/377; 5/618

[58] Field of Search ..... 5/618, 611, 613, 616, 5/617; 297/344.2, 377, 354.13

[56] References Cited

U.S. PATENT DOCUMENTS

| | | | |
|---|---|---|---|
| 2,702,072 | 2/1955 | Schuessler | 297/377 |
| 2,762,422 | 9/1956 | Stratton | 297/377 |
| 2,870,460 | 1/1959 | Sanford | 5/611 |
| 3,215,469 | 11/1965 | Wamsley | 297/344.18 |
| 4,409,695 | 10/1983 | Johnston et al. | 5/428 |
| 4,679,849 | 7/1987 | Torgny | 297/330 |
| 4,685,159 | 8/1987 | Oetiker | 5/618 |
| 5,193,633 | 3/1993 | Ezenwa | 5/618 |

FOREIGN PATENT DOCUMENTS

| | | | |
|---|---|---|---|
| 1134612 | 4/1957 | France | 297/377 |

*Primary Examiner*—Alexander Grosz

*Attorney, Agent, or Firm*—Dougherty, Hessin, Beavers & Gilbert

[57] ABSTRACT

A chain which is convertible to a table comprising: a base frame; a seat which is associatable with the base frame such that the seat is supported by the base frame and the seat can be raised and lowered with respect to the base frame; an electric motor assembly for raising and lowering the seat with respect to the base frame; a chair back which is pivotably associated with the seat; and a chair back support assembly, associated with the base frame, for supporting the chair back, wherein when the seat is raised with respect to the base frame, the chair back is positionable over the chair back support assembly in a substantially horizontal position and wherein the support assembly is operable for supporting the chair back in this substantially horizontal position.

14 Claims, 7 Drawing Sheets

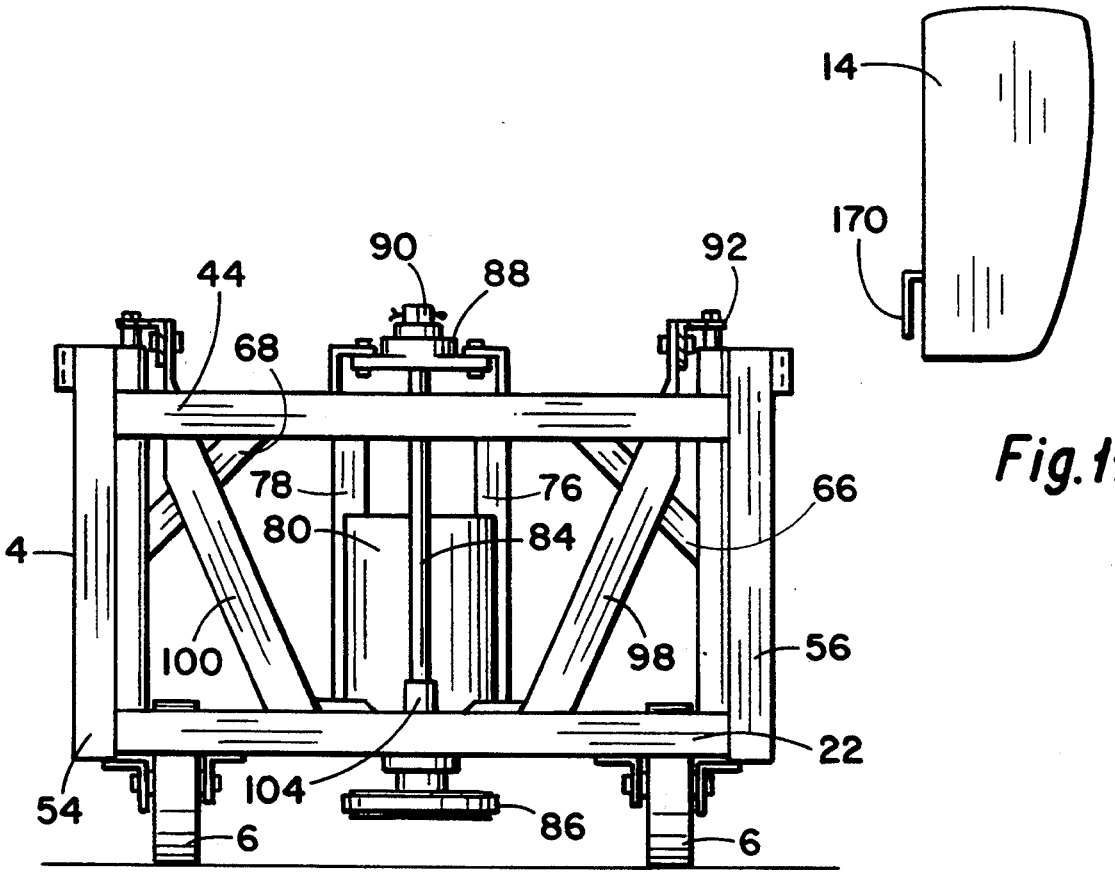
Fig. 11
Fig. 9
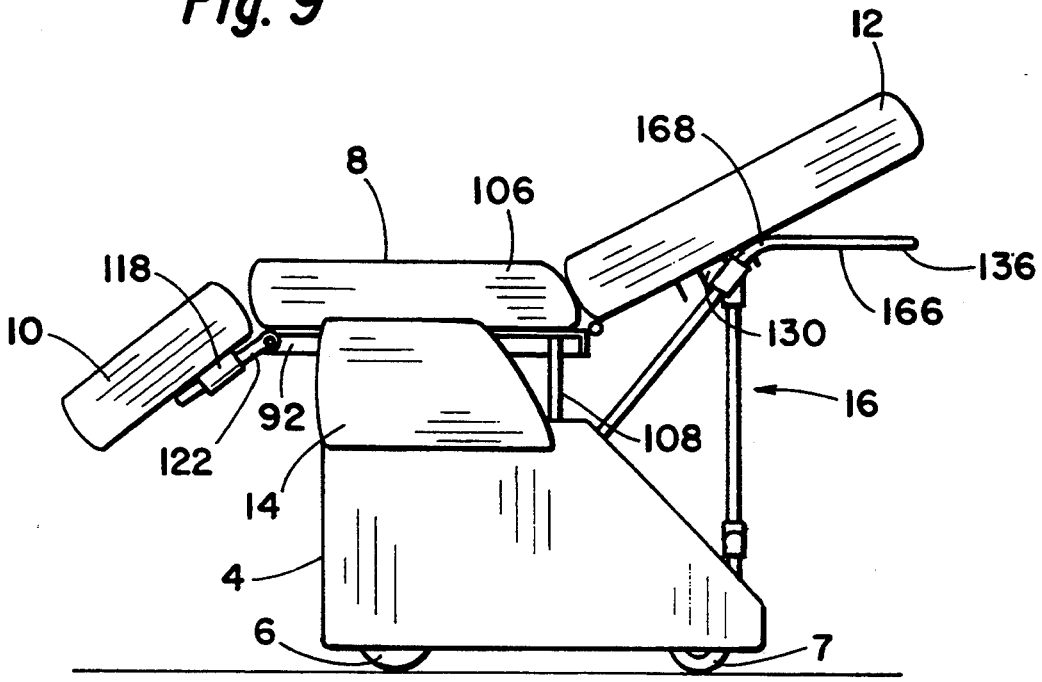
Fig. 10

CONVERTIBLE ROLLING CHAIR AND CHANGING TABLE FOR ADULT

This is a continuation-in-part of U.S. patent application Ser. No. 07/829,435 filed Feb. 3, 1992, now abandoned.

FIELD OF THE INVENTION

The present invention relates to chairs which are convertible to tables.

BACKGROUND OF THE INVENTION

A need presently exists for a chair which (a) can be conveniently rolled from one location to another, (b) has a chair back which can be placed in reclining position, and (c) can be converted to a flat table without having to transfer the patient seated therein. Such a chair could be conveniently used for transferring a patient from the chair to a bed and vice versa. The chair could also be used, for example, as a changing table for non-ambulatory adults who lack bowel and/or bladder control.

SUMMARY OF THE INVENTION

The present invention provides a chair which is convertible to a table. The chair comprises a base frame, a seat frame, a first adjusting member, a second adjusting member, and a rotating means. The first adjusting member includes a threaded portion. The first adjusting member has a longitudinal first end, a longitudinal second end, and a longitudinal axis extending therethrough. The first adjusting member is mounted in the base frame or the seat frame such that (1) each of the longitudinal ends of the first adjusting member is held at a fixed location with respect to the frame in which the first adjusting member is mounted but (2) the threaded portion of the first adjusting member can be rotated with respect to the frame in which the first adjusting member is mounted about the longitudinal axis of the first adjusting member. The second adjusting member is mounted in the other of said frames and includes a threaded portion. The threaded portion of the second adjusting member is threadedly associatable with the threaded portion of the first adjusting member such that, when the threaded portion of the second adjusting member is threadedly associated with the threaded portion of the first adjusting member and the threaded portion of the first adjusting member is rotated about the longitudinal axis of the first adjusting member, the seat frame moves with respect to the base frame along the longitudinal axis of the first adjusting member. The rotating means is operable for rotating the threaded portion of the first adjusting member about the longitudinal axis of the first adjusting member.

In accordance with the desired characteristics mentioned hereinabove, the inventive chair (a) can be easily rolled from one location to another, (b) can be placed in reclining position, and (c) can be converted to a flat table without having to first transfer the patient. The inventive chair is well-suited, for example, for use in transferring and caring for non-ambulatory invalid or semi-invalid patients in hospitals, in nursing facilities, or at home. The inventive chair provides comfort and mobility for the patient while minimizing the risk of injury to the patient and to the caregiver.

Further objects, features, and advantages of the present invention will be readily apparent upon reference to the accompanying drawings and upon reading the following description of the preferred embodiments.

BRIEF DESCRIPTION OF THE DRAWINGS

FIG. 9 provides a front view of the base frame 4 and the seat frame 92 of inventive apparatus 2 taken along line 9—9 shown in FIG. 4.

FIG. 10 provides an elevational side view of inventive apparatus 2 wherein apparatus 2 is midway between chair position and table position.

FIG. 11 provides an elevational front view of removable arm 14 of inventive apparatus 2.

DESCRIPTION OF THE PREFERRED EMBODIMENTS

Figure 1:
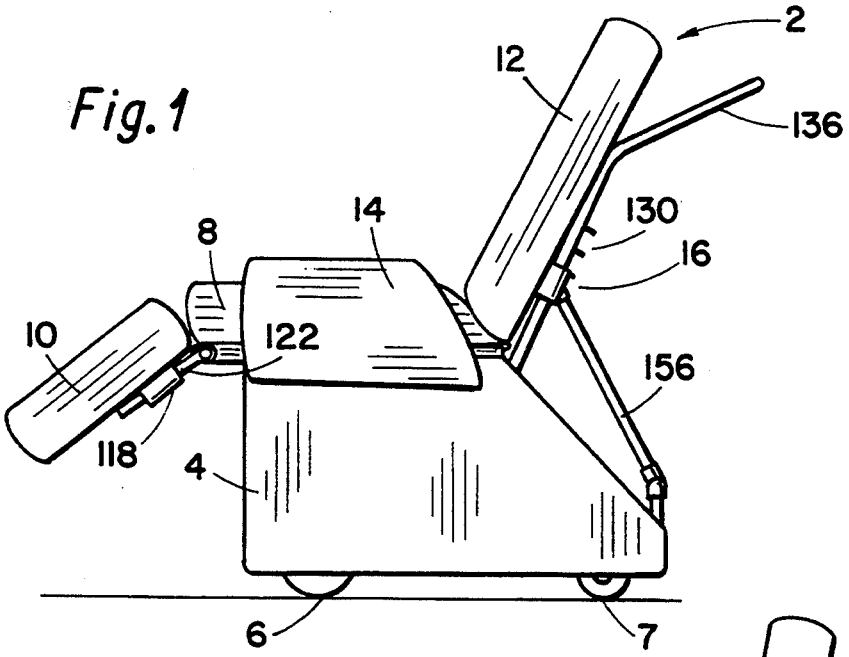
FIG. 1 provides an elevational side view of an embodiment 2 of the apparatus of the present invention.
Figure 2:
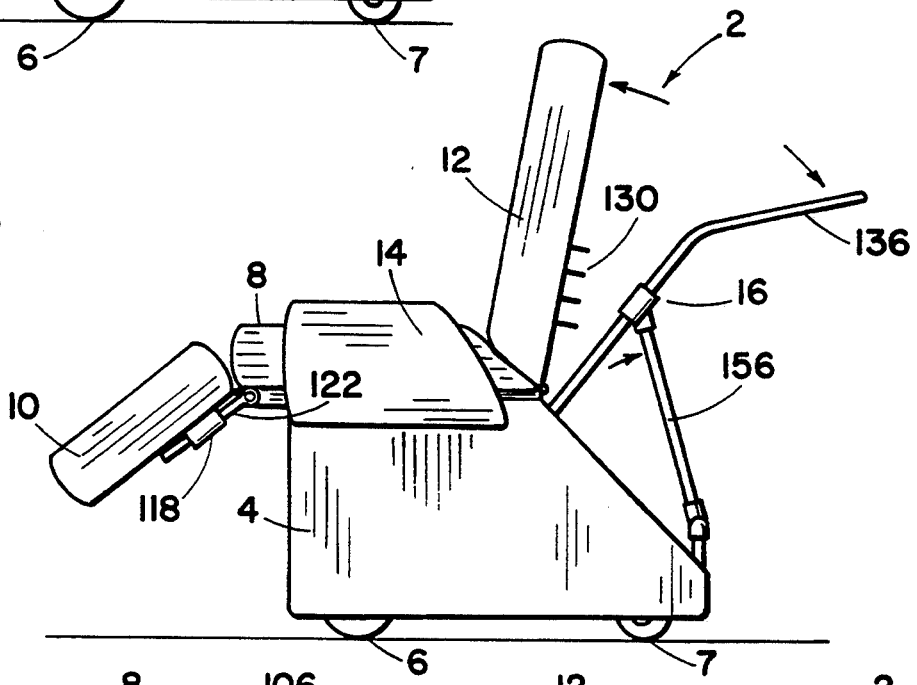
FIG. 2 provides a second elevational side view of inventive apparatus 2.
Figure 3:
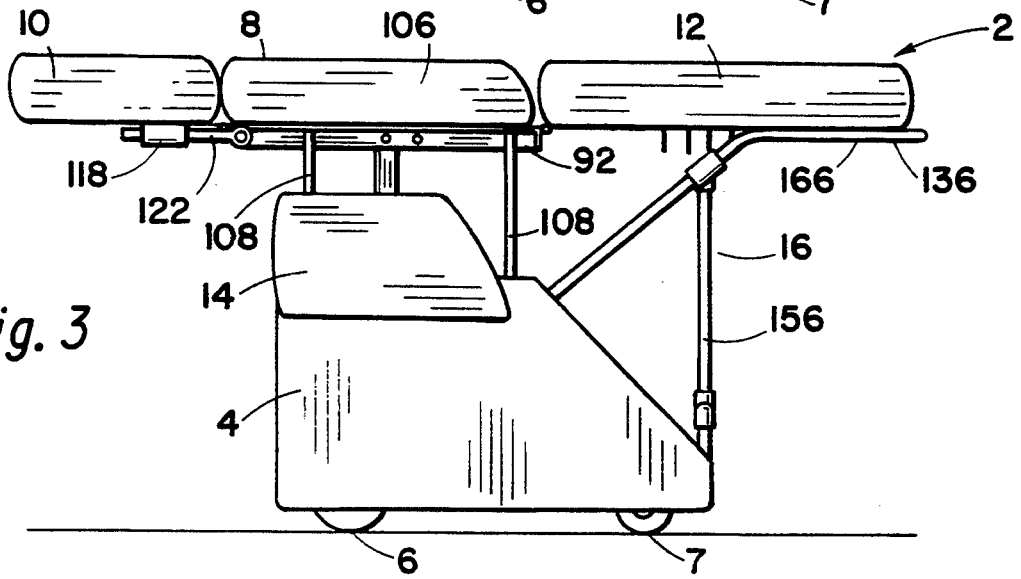
FIG. 3 provides an elevational side view of inventive apparatus 2 wherein inventive apparatus 2 is placed in table position.
Figure 4:
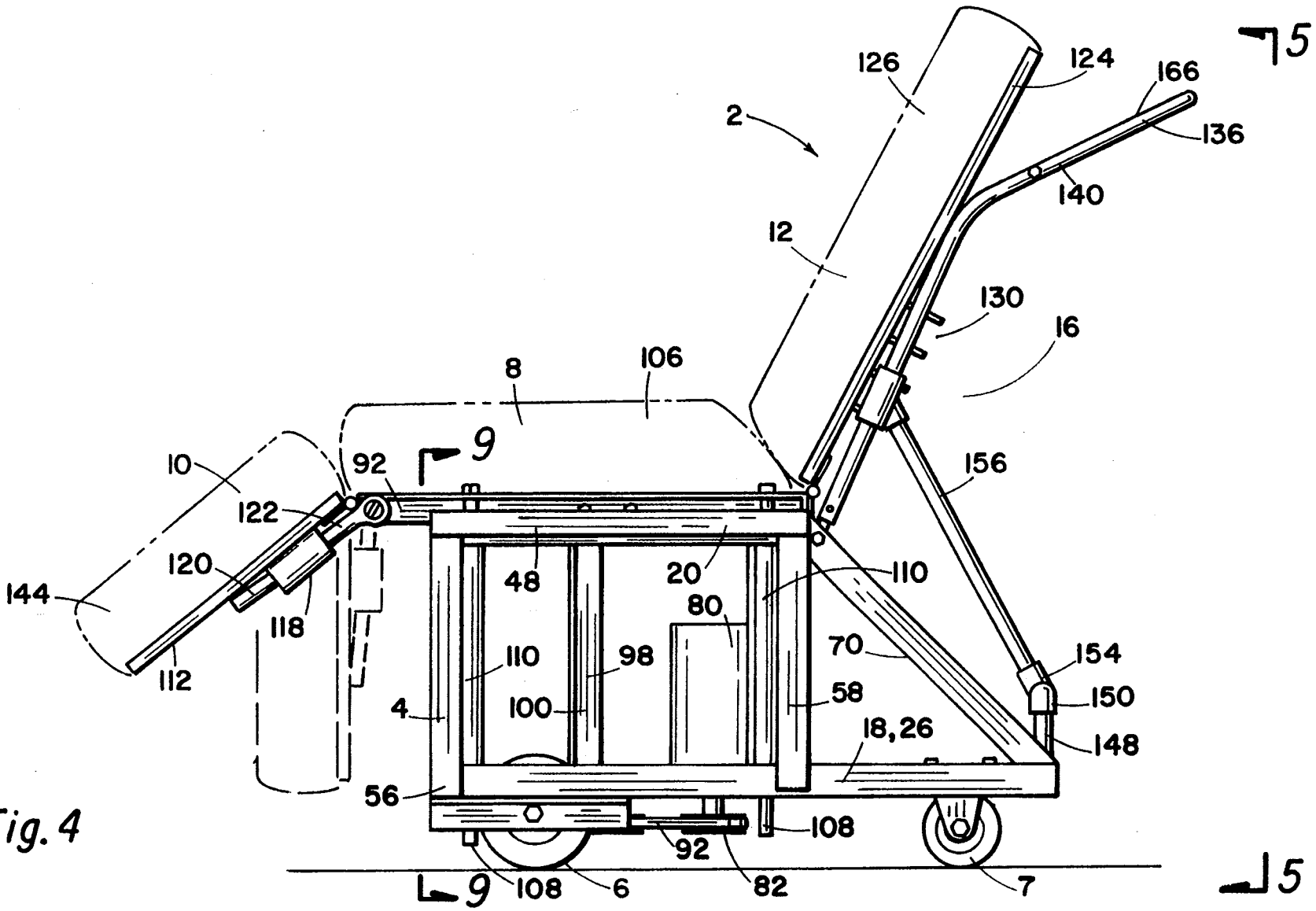
FIG. 4 provides a partially cutaway elevational side view of inventive apparatus 2.
Figure 5:
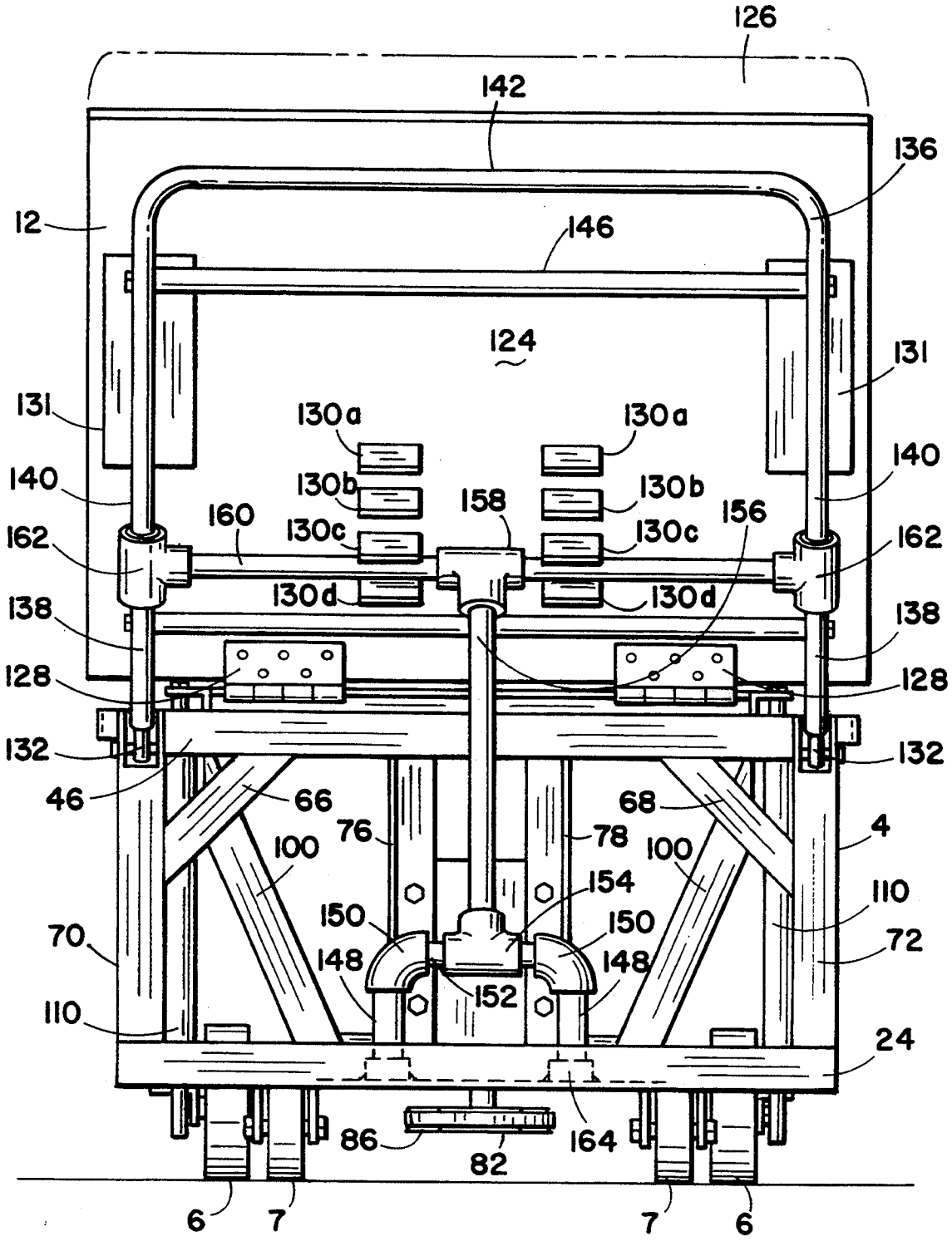
FIG. 5 provides an elevational back view of inventive apparatus 2 taken along line 5—5 shown in FIG. 4.
Figure 6:
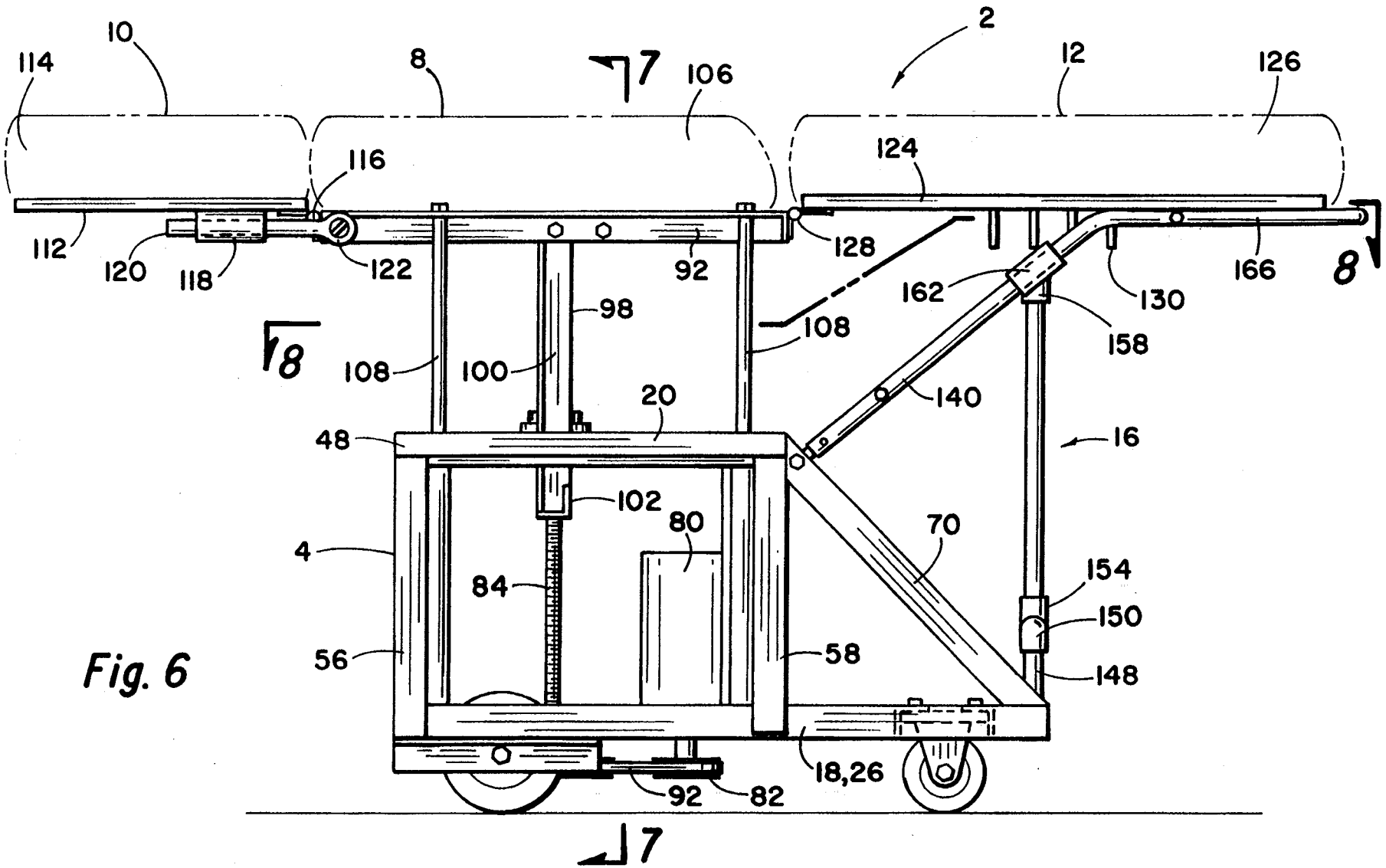
FIG. 6 provides a partially cutaway elevational side view of inventive apparatus 2 depicted in table position.

An embodiment 2 of the inventive apparatus is depicted in FIGS. 1–8. Apparatus 2 comprises a base 4; wheels 6 and 7 rotatably associated with the base; a seat assembly 8 which is associated with the base such that the seat assembly is supported by the base and the seat can be raised or lowered with respect to the base; a leg rest 10 which is pivotably associated with seat assembly 8; a backrest 12 which is pivotably associated with seat assembly 8; arm rests 14 which are removably associatable with base 4; and a backrest support assembly 16 for supporting backrest 12.

Base 4 comprises a frame structure including a rectangular bottom frame 18 and a rectangular top frame 20. Bottom frame 18 includes a front end 22, a back end 24, and sides 26. A lateral member 28 extends between sides 26 near the front end of bottom frame 18. Supports 30, 32, 34, and 36 extend between front end 22 of frame 18 and lateral member 28. Supports 30, 32, 34, and 36 are used for rotatably connecting front wheels 6 to base frame 18. A second lateral member 38 extends between supports 32 and 34. Third and fourth lateral members 40 and 42 extend between sides 26 near the back end 24 of bottom frame 18 and are used for operably connecting back wheels 7 to bottom frame 18. Rectangular top frame 20 includes a front end 44, a back end 46, and sides 48. Support members 50 and 52 extend between front end 44 and back end 46 of top frame 20.

Bottom frame 18 and top frame 20 are substantially the same width. However, bottom frame 18 is longer than top frame 20. Vertical supports 54 and 56 extend between the front corners of bottom frame 18 and top frame 20. Vertical supports 58 and 56 extend between the back corners of top frame 20 and sides 26 of bottom frame 18. Cross bracing members 62, 64, 66, and 68 are connected between top frame 20 and vertical supports 54, 56, 58, and 60 in order to provide additional strength for base frame 4. Sloping side support members 70 and 72 extend between back end 46 of top frame 20 and back end 24 of bottom frame 18.

An additional lateral support 74 (not shown) extends between sides 26 of bottom frame 18 at a position corresponding with the back end 46 of top frame 20. Vertical supports 76 and 78 extend between lateral support 74 and back end 46 of top frame 20. A reversible electric motor 80 having a pulley 82 operably associated therewith is bolted to vertical supports 76 and 78.

An electrical utility cord (not shown) can be provided in inventive apparatus 2 for operating electric motor 80 using an electrical utility outlet. Alternatively, batteries (not shown) can be positioned on base frame assembly 4 for powering electric motor 80.

An elongate threaded rod 84 extends between bottom frame 18 and top frame 20. The bottom end of rod 84 is connected to a pulley assembly 86. Pulley assembly 86 is rotatably connected to lateral members 28 and 38 of bottom frame 18. Rod 84 is associated with pulley 86 such that, when pulley 86 is rotated, rod 84 is also caused to rotate about its longitudinal axis.

Figure 7:
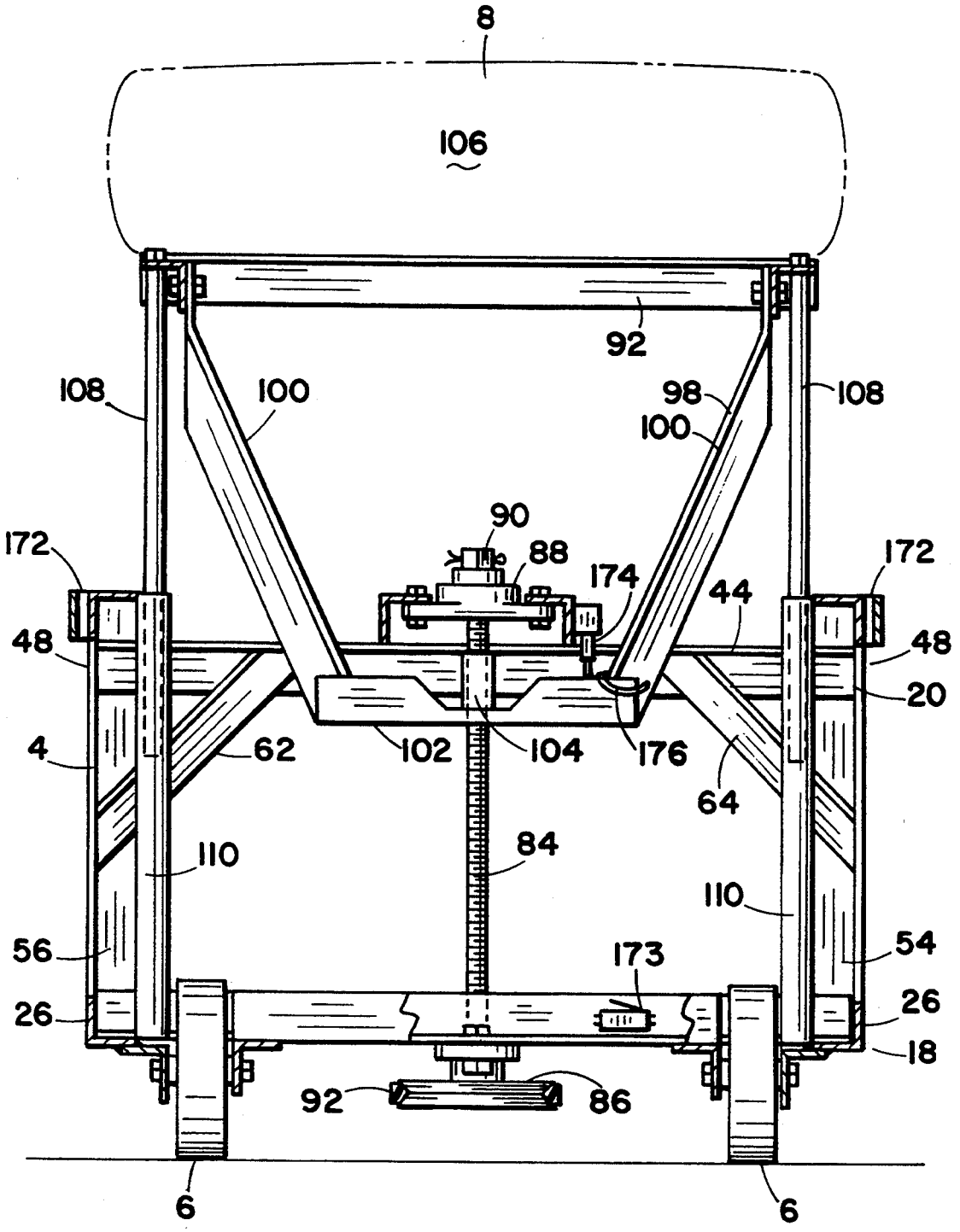
FIG. 7 provides a cutaway view taken along line 7—7 shown in FIG. 6.
Figure 8:
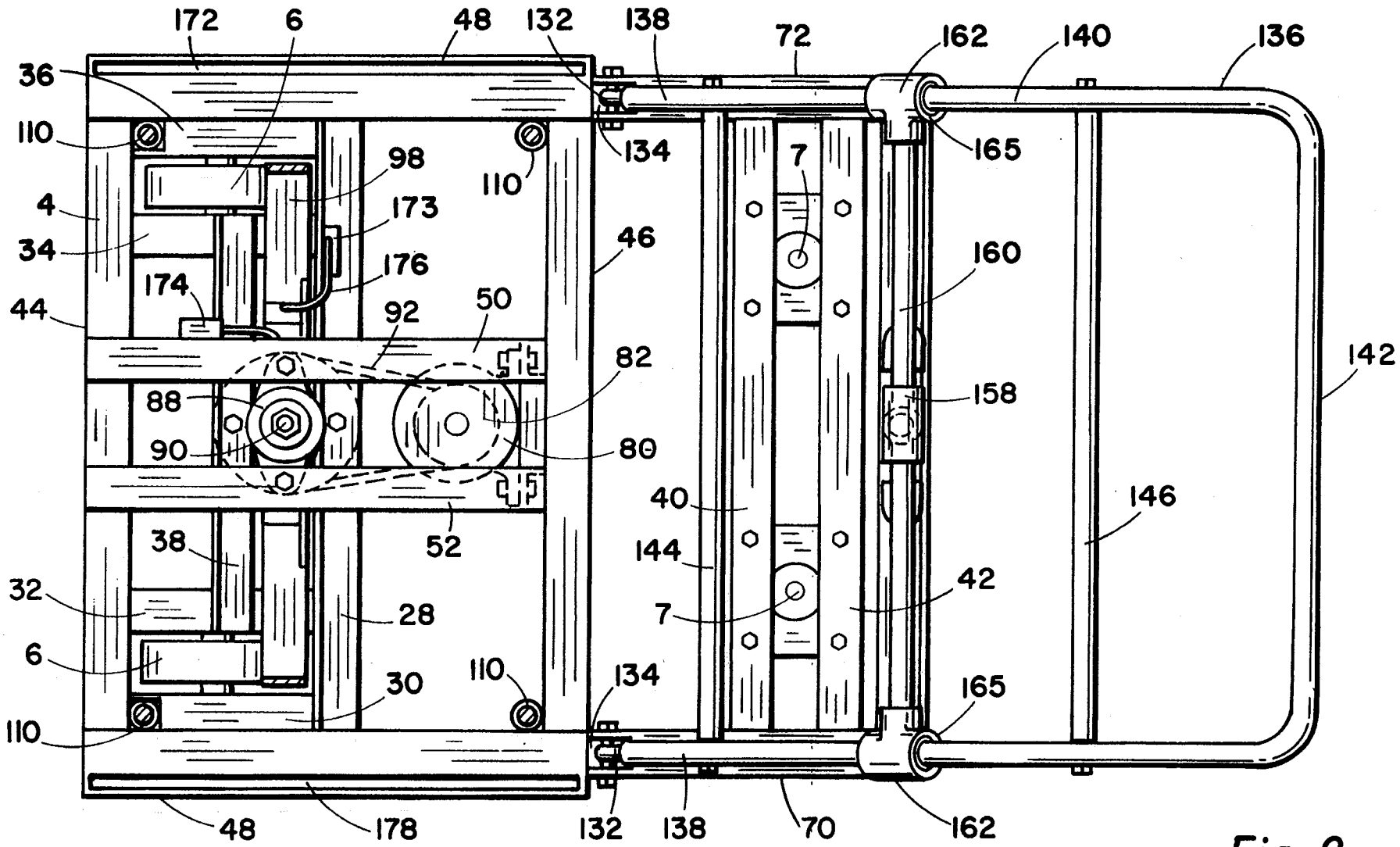
FIG. 8 provides a cutaway view of inventive apparatus 2 taken along line 8—8 shown in FIG. 6.

The top end of elongate threaded rod 84 extends through a bearing assembly 88. Bearing assembly 88 is connected to support members 50 and 52 of top frame 20. As shown in FIG. 7, the top end of rod 84 extends through bearing assembly 88 a sufficient distance to allow a pinned nut 90 to be connected to the top end of rod 84.

A belt 92 extends around pulleys 82 and 86 so that reversible electric motor 80 can be used to rotate elongate threaded rod 84 about its longitudinal axis. As elongate rod 84 rotates about its axis, it remains in fixed vertical position with respect to base frame 4.

Seat assembly 8 comprises a frame assembly including: a substantially horizontal rectangular frame structure 92; a V-shaped lift member 98 having inwardly and downwardly extending side members 100 and a substantially horizontal member 102 extending between the lower ends of side members 100; and an internally threaded member 104 extending through horizontal member 102. Internally threaded member 104 is operable for threadedly receiving elongate threaded rod 84. A seat cushion 106 is positioned on top of rectangular frame 92. Additionally, four guide rods 108 are attached to and extend downwardly from rectangular frame structure 92. When elongate threaded rod 84 is threadedly received in internally threaded member 104 of seat assembly 8, guide rods 108 are received in guide rod sleeves 110 provided in base frame 4.

Thus, seat assembly 8 can be raised and lowered with respect to base frame 4 by operating motor 80 in forward or reverse direction and thereby causing threaded rod 84 to rotate within internally threaded member 104. As seat assembly 8 moves vertically with respect to base frame 4, guide rods 108 slide within guide sleeves 110.

Leg rest 10 comprises a flat rectangular support 112 and a leg cushion 114 attached to the upper side of support 112. Rectangular support 112 is pivotably connected to rectangular frame 92 of seat assembly 8 by hinges 116. Sleeves 118 are provided on the bottom of rectangular support 112 for receiving the elongate ends 120 of ratchet members 122. Ratchet members 122 are pivotably connected to the sides of rectangular frame 92 of seat assembly 8 so that ratchet members 122 can be used to hold leg rest 10 at generally any desired angle with respect to seat assembly 8.

Backrest 12 comprises a flat rectangular support 124 having a back cushion 126 positioned on the top thereof. Rectangular support 124 is pivotably connected to rectangular frame 92 of seat assembly 8 by hinges 128. Catch members 130 are provided on the bottom of rectangular support 124. Catch members 130 are operable for receiving backrest support assembly 16 such that backrest support assembly 16 will support backrest 12 in four different reclining positions. Pads 131 are also provided on the bottom of rectangular support 124 to protect backrest 12 from abrasion damage which might otherwise occur when backrest 12 is moved into and out of table position.

Backrest support assembly 16 comprises: rods 132 pivotably connected in slots 134 provided in the upper ends of sloping side support members 70 and 72; a generally U-shaped handle 136 having tubular ends 138 for receiving rods 132, substantially parallel side members 140 which bend away from backrest 12, and a handlebar 142 extending across the distal end of U-shaped handle 136; and supports 144 and 146 connected between side members 140. Backrest support assembly 16 further comprises: parallel vertical members 148 which are connected to the back end 24 of bottom frame 18; elbows 150 connected to the upper ends of members 148; a crosspiece 152 connected between elbows 150 and extending through a first tee 154; an elongate support member 156 extending from first tee 154; a second tee 158 connected to the upper end of elongate member 156; a lateral support member 160 extending through second tee 158; and third and fourth tees 162 which are connected to the ends of lateral member 160 and are positioned around side members 140.

First tee 154 and elongate support member 156 pivot around crosspiece 152. Third and fourth tees 162, on the other hand, slide along side members 140. Thus, by (a) raising backrest 12, (b) pushing handlebar 142 forward or pulling handlebar 142 backward, and then (c) lowering backrest 12, lateral support member 160 can be placed beneath any desired pair of catch members 130. The particular pair of catch members chosen will determine the reclining angle of the chair back. When lateral support member 160 is positioned beneath a desired pair of catch members 130 in the manner depicted in FIGS. 1, 4, and 5, tees 162 are prevented from sliding along side members 140 and first tee 154 is prevented from rotating around crosspiece 152 such that lateral support member 160, elongate support member 156, tee 154, crosspiece 152, elbows 150, and vertical members 148 operate to support backrest 12 in reclining position.

In one embodiment of the present invention, elongate member 156, crosspiece 152, lateral support member 160, and vertical members 148 are preferably formed from PVC pipe. Additionally, elbows 150 and tees 154, 158, and 162 are formed from PVC. Vertical members 148 can be connected to back end 24 of frame 18 by, for example, using threaded steel couplings 164 which are welded or otherwise connected to frame 18.

In another embodiment, all of members 156, 152, 160, 148, 150, 154, 158, 162, and 164 are preferably metal. In this embodiment, plastic inserts 165 are preferably provided in tees 162 to reduce friction and thereby facilitate the sliding movement of tees 162 along side members 140.

Inventive apparatus 2 can be automatically taken from a chair position to a table position regardless of which set of catch members 130 lateral support member 160 happens to be positioned between. However, when taking apparatus 2 from chair position to table position, lateral member 160 is preferably positioned between catch members 130*b* and 130*c*.

To convert apparatus 2 from chair to table position, electric motor 80 is switched on so that seat assembly 8 is raised with respect to base frame 4. As seat assembly 8 rises with respect to the base frame 4, backrest 12 also moves upward. As backrest 12 moves upward, backrest 12 and catch members 130 push against lateral support member 160 such that lateral support member 160 and tees 162 slide outward on side members 140. At the same time, elongate member 156 and tee 154 rotate upward around crosspiece 152 and rods 132 pivot downward in slots 134. Thus, as seat assembly 8 and backrest 12 move upward, backrest 12 also pivots slowly toward horizontal position.

When taking apparatus 2 from chair position to table position, the movement of backrest support assembly 16 stops when outer portion 166 of handle 136 reaches a substantially horizontal position. Before or at about the same time that outer portion 166 of handle 136 reaches horizontal position, pads 131 on the bottom of backrest 12 contact handle 136 at about bend 168 (see FIG. 10). Backrest 12 then slides over and essentially pivots around bend 168 and onto the horizontal outer portion 166 of handle 136. As backrest 12 pivots around bend 168, backrest support 124 and catch members 130 are lifted off of lateral member 160 of backrest support assembly 16. Consequently, when seat assembly 8 and backrest 12 are fully raised, backrest 12 is supported in horizontal position by outer portion 166 of handle 136.

To take inventive apparatus 2 from table position to chair position, electric motor 80 is simply operated in reverse such that seat assembly 8 and backrest 12 are lowered toward base frame 4. As backrest 12 is lowered, it pivots inward over bend 168 until lateral support member 160 is received between a set of catch members 130. With lateral member 160 thus positioned under catch members 130, the continued downward movement of backrest 12 causes lateral support member 160 and tees 162 to slide downward along side members 140 toward base frame 4. At the same time, elongate support member 156 and first tee 154 pivot inward and rods 132 pivot upward in slots 134. Thus, as seat assembly 8 and backrest 12 move downward, backrest 12 also moves to the reclining position determined by the particular set of catch members 130 between which lateral member 160 has been received.

When the embodiment of apparatus 2 shown in FIGS. 1–11 is taken from table position to chair position, lateral member 160 will always mate with a particular set of catch members 130. In this case, lateral member 160 will always be received between catch members 130*b* and 130*c*. After seat assembly 8 and backrest 12 are lowered, the reclining angle of backrest 12 can be changed by placing lateral support member 160 between a different set of catch members 130.

Arm rests 14 are preferably removably attachable to base frame 12. As shown in FIG. 11, each arm rest 14 preferably has a clip 170 positioned on the inside thereof. Clips 170 are sized to be removably received in slots 172 provided in the sides of top frame 20 of base assembly 4. Arm rests 14 can thus be removed from inventive apparatus 2 in order to facilitate the use of apparatus 2 in transferring a patient from inventive apparatus 2 to a bed or vice versa.

Limit switches 173 and 174 are provided in inventive assembly 2 in order to stop electric motor 80 whenever seat assembly 8 has been fully raised or fully lowered with respect to base frame assembly 4. Limit switch 173 is provided on bottom frame 18 of base frame assembly 4 while limit switch 174 is provided on top frame 20 of base frame assembly 4. Whenever seat assembly 8 is fully raised with respect to base frame 4, horizontal member 102 of seat assembly 8 contacts limit switch 174 such that limit switch 174 operates to shut off electric motor 80 and thus stop the upward movement of seat assembly 8. Whenever seat assembly 8 is fully lowered with respect to base frame assembly 4, a bracket arm 176 connected to horizontal member 102 of seat assembly 8 contacts limit switch 173 such that limit switch 173 operates to shut off electric motor 80 and thus stop the downward movement of seat assembly 8.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A chair which is convertible to a table, comprising:
a base frame;
a seat which is associatable with said base frame such that said seat is supported by said base frame and said seat can be raised and lowered with respect to said base frame;
raising and lowering means for raising and lowering said seat with respect to said base frame;
a chair back which is pivotably associated with said seat; and
a chair back support means, associated with said base frame, for supporting said chair back,
wherein, when said seat is raised with respect to said base frame the chair back is rotated rearwardly from an inclined position to a substantially horizontal position, said support means being operable for supporting said chair back when said chair back is in said substantially horizontal portion.

2. A chair as described in claim 1 wherein said chair back support means comprises:
a first elongate side member;
a second elongate side member substantially parallel to said first elongate side member; and
a support structure having a first end and a second end, said first end being pivotably associated with said base frame, said second end including a first sleeve member which is slidably connected to said first elongate side member, and said second end further including a second sleeve member which is slidably connected to said second elongate side member.

3. A chair as described in claim 1 further comprising:
a leg rest pivotably associated with said seat and
a ratchet means for holding said leg rest in fixed position with respect to said seat.

4. A chair as described in claim 1 further comprising an arm rest which is removably attachable to said base frame.

5. A chair which is convertible to a table, comprising:
a base frame;
an elongate first threaded member having a longitudinal axis, said first threaded member being mounted in said base frame such that each end of said first threaded member is held at a fixed location with respect to said base frame but said first threaded member can be rotated with respect to said base frame about said longitudinal axis;

a seat structure;

a second threaded member mounted in said seat structure, said second threaded member being threadedly associatable with said first threaded member such that, when said second threaded member is threadedly associated with said first threaded member and said first threaded member is rotated about said longitudinal axis, said seat structure moves with respect to said base frame along said longitudinal axis;

rotating means for rotating said first threaded member about said longitudinal axis;

a chair back which is pivotably associated with said seat structure and;

a chair back support means, associated with said base frame, for supporting said chair back, said chair back support means being operable for supporting said chair back at at least one reclining angle, wherein, when said seat structure is raised with respect to said base frame the chair back is rotated rearwardly from an inclined position to a substantially horizontal position, said support means being operable for supporting said chair back when said chair back is in said substantially horizontal position.

6. A chair as described in claim 5 further comprising limiting means for limiting the movement of said seat structure with respect to said base frame along said longitudinal axis.

7. A chair as described in claim 6 wherein said rotating means comprises an electric motor and said limiting means comprises a limiting switch for shutting off said electric motor.

8. A chair as described in claim 5 wherein said first threaded member is a male threaded member and said second threaded member is a female threaded member.

9. A chair as described in claim 5 wherein one of said base frame and said seat structure includes at least one guide rod and the other of said base frame and said seat structure includes at least one guide sleeve, said guide rod being receivable in said guide sleeve such that said guide rod slides in said guide sleeve when said second threaded member is threadedly associated with said first threaded member and said seat structure moves with respect to said base frame along said longitudinal axis.

10. A chair as described in claim 5 wherein said chair back support means comprises:

a first elongate side member;

a second elongate side member substantially parallel to said first elongate side member; and a support structure having a first end and a second end, said first end being pivotably associated with said base frame, said second end including a first sleeve member which is slidably connected to said first elongate side member, and said second end further including a second sleeve member which is slidably connected to said second elongate side member.

11. A chair as described in claim 5 further comprising an arm rest which is removably attachable to said base frame.

12. A chair as described in claim 5 further comprising a leg rest pivotably associated with said seat structure.

13. A chair as described in claim 12 further comprising a ratchet means for holding said leg rest in fixed position with respect to said seat.

14. A chair as described in claim 5 further comprising a plurality of wheels rotatably associated with said base frame.

* * * * *

UNITED STATES PATENT AND TRADEMARK OFFICE

CERTIFICATE OF CORRECTION

PATENT NO. : 5,342,114

DATED : August 30, 1994

INVENTOR(S) : Olive L. Burke and Jesse G. Lewis

It is certified that error appears in the above-identified patent and that said Letters Patent is hereby corrected as shown below:

On the title page:
IN THE ABSTRACT:

Line 1, change "chain" to --chair--.

Signed and Sealed this

Fifteenth Day of November, 1994

*Attest:*

*Attesting Officer*

BRUCE LEHMAN

*Commissioner of Patents and Trademarks*